US006539556B1

(12) United States Patent
Barker

(10) Patent No.: US 6,539,556 B1
(45) Date of Patent: Apr. 1, 2003

(54) INCONSPICUOUSLY PROTECTIVE HEADWEAR

(76) Inventor: David A. Barker, 1053 Nixon, Boerne, TX (US) 78006

( * ) Notice: Subject to any disclaimer, the term of this patent is extended or adjusted under 35 U.S.C. 154(b) by 0 days.

(21) Appl. No.: 09/504,348

(22) Filed: Feb. 14, 2000

(51) Int. Cl.[7] ..... A42B 1/06
(52) U.S. Cl. ..... 2/410; 2/411; 2/425; 2/195.1
(58) Field of Search ..... 2/410, 411, 425, 2/414, 195.1, 195.7

(56) References Cited

U.S. PATENT DOCUMENTS

| | | | | | |
|---|---|---|---|---|---|
| 2,717,384 | A | * | 9/1955 | Frothingham | 2/414 |
| 4,581,773 | A | * | 4/1986 | Cunnane | 2/204 |
| 5,226,180 | A | * | 7/1993 | Leach | 2/411 |
| 5,269,026 | A | * | 12/1993 | McManus | 2/411 |
| 5,289,591 | A | * | 3/1994 | Anderson | 2/411 |
| 5,437,064 | A | * | 8/1995 | Hamaguchi | 2/414 |
| 5,461,730 | A | * | 10/1995 | Carrington | 2/411 |
| 5,481,759 | A | * | 1/1996 | Rinaldi | 2/195.1 |
| RE35,193 | E | * | 4/1996 | Shifrin | 2/410 |
| 5,519,895 | A | * | 5/1996 | Barnes, Jr. | 2/422 |
| 5,666,669 | A | * | 9/1997 | Sewell | 2/195.1 |
| 5,692,244 | A | * | 12/1997 | Johnson et al. | 2/181 |
| 5,882,205 | A | * | 3/1999 | Peterson | 2/425 |
| 5,887,289 | A | * | 3/1999 | Theoret | 2/425 |
| 5,930,841 | A | * | 8/1999 | Lampe et al. | 2/411 |
| 5,950,244 | A | * | 9/1999 | Fournier et al. | 2/414 |
| 6,065,159 | A | * | 5/2000 | Hirsh | 2/425 |

* cited by examiner

*Primary Examiner*—Rodney M. Lindsey
(74) *Attorney, Agent, or Firm*—Wayne J. Colton, Inc.

(57) ABSTRACT

An apparel adapted for use in a confined space as a protective headwear generally comprises a crown adapted for close conformation about a wearer's scalp and a protective element for safekeeping of the wearer's scalp from blunt trauma. The crown consists essentially of a soft fabric such as, for example, cotton and is preferably machine washable. The protective element, which is preferably substantially centrally positioned on an interior face of the crown, comprises a resiliently flexible material such as, for example, plastic. The protective element is shaped to disseminate the force of a potentially traumatic impact over a region of the wearer's scalp, thereby protecting the wearer from injury. A short bill is also affixed to a portion of the edge of the crown. According to the invention, this bill should extend no more than about two inches outward from the crown to prevent deflection of the apparel from the wearer's head. Like the crown, the bill is preferably entirely constructed of a soft fabric such as cotton—ensuring maximum access to confined spaces and being also readily machine washable.

16 Claims, 1 Drawing Sheet

INCONSPICUOUSLY PROTECTIVE HEADWEAR

FIELD OF THE INVENTION

The present invention relates to protective headwear. More particularly, the invention relates to an apparel adapted for use in confined spaces as an inconspicuously protective headwear.

BACKGROUND OF THE INVENTION

Automobile mechanics and others who must work in confined spaces must endure bumps and scrapes to the head as part of their daily routine. While for most, these occasional minor injuries are but a "part of the job," for those who have also experienced hair loss each impact is a major blow—to the pride as well as the head. As those who have suffered hair loss know all to well, each and every minor cut, scrape or bruise to the head leaves a glaring mark, often for days at a time. For those who work in professions like the automotive repair industry, where tight spaces must be routinely accessed, such marks are the badge of the trade.

Unfortunately, standard protective headwear is generally not suited for use by automobile mechanics and the like. This is because the tight spaces that mechanics must negotiate, coupled with the necessity to be able to see their work product, make the wear of bulky hardhats and the like infeasible. Further, even if a hardhat was practical, many people who suffer hair loss would prefer to risk the injury to their head over the injury to their pride that might follow being forced to wear a conspicuous specialized protective apparel. As a result, a protective headwear that is both adapted for use in a confined space and is totally inconspicuous is desperately needed.

With the deficiencies of the prior art in mind, it is therefore a primary object of the present invention to improve over the prior art by providing a protective headwear especially adapted for use by balding automobile mechanics that conceals its protective elements. It is another objective of the present invention to provide such a headwear that is also comfortable to wear, stylish and easily cared for notwithstanding the hot and greasy environment of the automobile garage. Finally, it is yet another object of the present invention to provide such a headwear that is economical to produce such that it may be purchased within the budget of any hourly wage earner.

SUMMARY OF THE INVENTION

In accordance with the foregoing objects, the present invention—an apparel adapted for use in a confined space as a protective headwear—generally comprises a crown adapted for close conformation about a wearer's scalp and a protective element for safekeeping of the wearer's scalp from blunt trauma. The crown consists essentially of a soft fabric such as, for example, cotton and is preferably machine washable. The protective element, which is preferably substantially centrally positioned on an interior face of the crown, comprises a resiliently flexible material such as, for example, plastic. As will be better understood further herein, the protective element is shaped to disseminate the force of a potentially traumatic impact over a region of the wearer's scalp, thereby protecting the wearer from injury. Such shapes as have been found adequate for this purpose include, but are not necessarily limited to, a segment of an ellipsoid or a segment of a sphere.

In one preferred embodiment, the protective element is permanently affixed to the interior face of the crown. In another, more preferred embodiment, however, the protective element is removably affixed to the interior face of the crown by utilization of hook and loop type fasteners or the like. Although those of ordinary skill in the art will recognize that such a removable configuration ensures that the apparel can be readily washed, it will also be appreciated that a plastic protective element, securely sewn or glued in place may likewise be washable with little or no sacrifice in utility.

Finally, in the preferred embodiment of the present invention, the apparel also comprises a short bill affixed to a portion of the edge of the crown. According to the invention, this bill should extend no more than about two inches outward from the crown to prevent deflection of the apparel from the wearer's head. Like the crown, the bill is preferably entirely constructed of a soft fabric such as cotton—ensuring maximum access to confined spaces and being also readily machine washable. These and many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
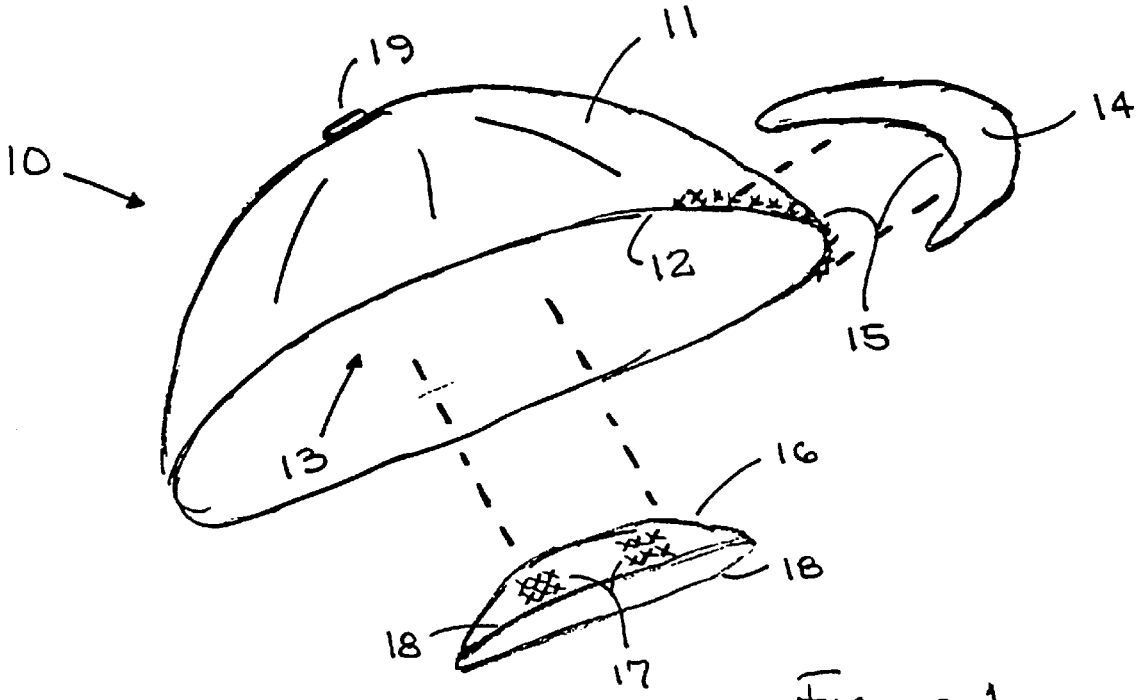
FIG. 1 shows, in a partially exploded perspective view, the apparel of the preferred embodiment of the present invention.
Figure 2:
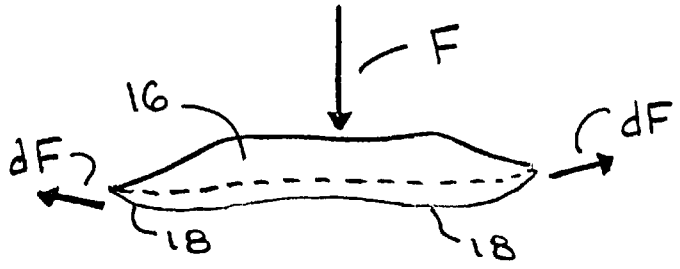
FIG. 2 shows, in a perspective view, the protective element of the apparel of FIG. 1 as flexed under a blunt force.

Referring now to FIG. 1, the preferred embodiment of the protective headwear 10 of the present invention is shown to generally comprise a crown 11, such as commonly provided in a baseball cap or the like, and a protective element 16 adapted for insertion therein. As shown in the Figure, the protective headwear 10 may also comprise a bill 14, which, as will be better understood further herein, is preferably smaller than those generally known in the headwear arts. In use, the protective element 16, which is concealed from general view by the crown 11, absorbs the impact of any moderate blunt force F, disseminating the force F to the outer perimeter 18 of the protective element 16 and upward and away from the wearer's head. The resulting disseminated force dF is generally non-traumatic to the wearer, preventing injury that might otherwise cause marring of the scalp.

As shown in FIG. 1, the protective element 16 is of similar shape as the crown 11, but, smaller for insertion therein. In order to dissipate a blunt force F, the protective element 16 is also preferably formed in the shape of a segment of an ellipsoid, which may include a sphere. Likewise, the protective element 16 is preferably constructed from a resiliently flexible material such as, for example, a deformable plastic. Those of ordinary skill in the art, however, will recognize myriad substantially equivalent materials that may be substituted within the spirit and scope of the present invention and without loss of function.

As also shown in FIG. 1, the protective element 16 is also preferably removably affixed to an interior face 13 of the crown 11 to facilitate machine washing of the protective headwear 10, which preferably comprises a soft cotton fabric. As will be appreciated by those of ordinary skill in the art, the protective element 16 may be removably affixed to the crown 11 by the provision of releasably engageable hook and loop type fasteners 17, commonly available under the well known trademark "VELCRO." Those of ordinary skill in the art will also recognize, however, that many of the features of the present invention, including the adaptability for machine washing, may also be appreciated in embodiments wherein the protective element 16 is permanently affixed to the interior face 13 of the crown 11. In such an embodiment, the protective element 16 may be sewn about its perimeter 18 to the crown 11, hot glued in place or permanently and machine washably affixed in some other substantially equivalent manner.

Finally, a bill 14 is also provided in the preferred embodiment of the present invention. According to the teachings herein, this bill 14 should extend no more than about two inches outward from the edge 12 of the crown 11 in order to prevent deflection of the protective headwear 10 from the wearer's head during use. Likewise, the bill 14 should, like the crown 11, consist essentially of a soft material such as, for example, cotton fabric. In this manner, the protective headwear 10 is prevented from hanging on engine parts or the like and is also readily machine washable. As shown in FIG. 1, however, the bill 14 may be permanently affixed, like the protective element 16, or may be detachably affixed with, for example, hook and loop type fasteners 15.

In use, the balding mechanic may wear the protective headwear 10 just like any other favorite hat. Further, because the protective element is concealed within the crown 11 of the headwear 10, the mechanic need not fear the ridicule of his fellow mechanics. When a blunt force F impacts the crown 11, and thereafter the protective element 16, the force F is absorbed by the protective element 16 and disseminated outward and away from the wearer's head due to the flexure of the protective element 16. The resulting disseminated force dF will then be generally non-traumatic to the wearer.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, a button 19 or the like as commonly found on baseball caps may be added to the top of the protective headwear 10 without any loss of function. In this manner, the likelihood that anyone other than the wearer will realize that a protective headwear is being employed is further diminished. In any case, because the scope of the present invention is much broader than any particular embodiment, the foregoing detailed description should not be construed as a limitation of the scope of the present invention, which is limited only by the claims appended hereto.

What is claimed is:

1. An apparel adapted for use in a confined space as an inconspicuously protective headwear, said apparel comprising:

a streamlined crown adapted for close conformation about a wearer's scalp, said crown consisting essentially of a soft fabric;

a bill, said bill projecting outward from a portion of the edge of said crown;

a protective element for safekeeping of the wearer's scalp from blunt trauma, said protective element being substantially centrally positioned on an interior face of said crown and small in size relative to said crown such that said protective element comports with said apparel's inconspicuous quality and facilitates close conformation of said crown about the wearer's scalp; and wherein said protective element consists essentially of a thin sheet of resiliently flexible plastics material.

2. The apparel as recited in claim 1, wherein said soft fabric is washable.

3. The apparel as recited in claim 2, wherein said soft fabric comprises cotton.

4. The apparel as recited in claim 1, wherein said protective element further comprises a shape adapted to disseminate the force of a potentially traumatic impact over a region of the wearer's scalp, the resulting disseminated force being non-traumatic to the wearer's scalp.

5. The apparel as recited in claim 4, wherein said shape comprises a segment of an ellipsoid.

6. The apparel as recited in claim 5, wherein said ellipsoid comprises a sphere.

7. The apparel as recited in claim 1, wherein said protective element is permanently affixed to said interior face of said crown.

8. The apparel as recited in claim 7, wherein said protective element is perimetrically stitched to said crown.

9. The apparel as recited in claim 7, wherein said protective element is glued to said crown.

10. The apparel as recited in claim 1, wherein said protective element is removably affixed to said interior face of said crown.

11. The apparel as recited in claim 10, said apparel further comprising hook and loop type fasteners for affixing said protective element to said crown.

12. The apparel as recited in claim 1, wherein said bill projects no more than about two inches from said crown.

13. The apparel as recited in claim 12, wherein said bill consists essentially of a soft material.

14. The apparel as recited in claim 13, wherein said bill is permanently affixed to said crown.

15. The apparel as recited in claim 13, wherein said bill is detachably affixed to said crown.

16. The apparel as recited in claim 15, said apparel further comprising hook and loop type fasteners for affixing said bill to said crown.

* * * * *